United States Patent [19]

Kranz

[11] Patent Number: 4,505,224

[45] Date of Patent: Mar. 19, 1985

[54] APPARATUS FOR ELECTROSTATICALLY COATING ELONGATED WORKPIECES WITH FLOCK

[75] Inventor: Jürgen Kranz, Lindau, Fed. Rep. of Germany

[73] Assignee: Metzeler Kautschuk GmbH, Munich, Fed. Rep. of Germany

[21] Appl. No.: 529,026

[22] Filed: Sep. 2, 1983

[30] Foreign Application Priority Data

Sep. 2, 1982 [DE] Fed. Rep. of Germany ..... 3232687

[51] Int. Cl.[3] ..... B05B 5/02

[52] U.S. Cl. ..... 118/636; 118/602; 118/638

[58] Field of Search ..... 118/636, 602, 638, 640, 118/312, 24

[56] References Cited

U.S. PATENT DOCUMENTS 2,811,134 10/1957 Friderici ..... 118/309

3,870,013 3/1975 Wagner ..... 118/312

*Primary Examiner*—Norman Morgenstern

*Assistant Examiner*—K. Jaconetty

*Attorney, Agent, or Firm*—Herbert L. Lerner; Laurence A. Greenberg

[57] ABSTRACT

Apparatus for electrostatically flock-coating elongated workpieces on a conveyor belt, wherein flock charged by an electrostatic field drops upon a workpiece from a feed opening located above the workpiece to be flock-coated, and excess flock is collected at the bottom of the apparatus and returned to the feed opening, which includes a stationary cylindrical inner housing having a substantially horizontal longitudinal axis and formed with a feed opening, the feed opening being elongated and located in a region of the cylindrical housing on an upper apex line thereof, the housing being also formed with a discharge gap in a lower region thereof whereat the conveyor belt is simultaneously disposed; a cylindrical outer jacket coaxially surrounding and spaced from the cylindrical inner housing and being rotatable about the inner housing; and elastic transport strips disposed in the space between the inner housing and the outer jacket and fastened to the outer jacket, the elastic transport strips extending along generatrix lines and bridging the space between the inner housing and the outer jacket.

6 Claims, 2 Drawing Figures

APPARATUS FOR ELECTROSTATICALLY COATING ELONGATED WORKPIECES WITH FLOCK

Figure 1:
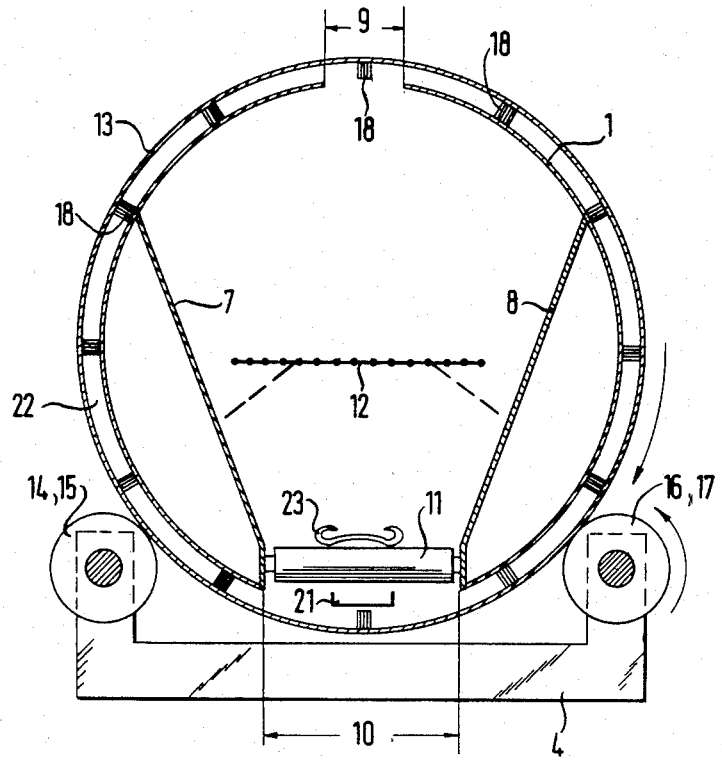

The invention relates to apparatus for electrostatically coating elongated workpieces, especially extrusions, with flock on a conveyor, wherein the flock, charged by an electrostatic field, drops upon the workpiece from a feed opening above the workpiece which is to be flock-coated, and excess flock is collected at the bottom of the apparatus and transported back to the feed opening.

Such a flock-coating apparatus, which serves especially for flock-coating rubber sections or profiles for the production of motor vehicles, such as window or door gasket sections, is disclosed, for example, in U.S. Pat. No. 2,811,134. This patent describes the flock as being fed from an elevated bin via a brush chamber with dosing or metering brushes and through a dosing or metering screen to an electrostatic field and dropping therefrom onto the workpieces to be flock-coated, which are generally transported by a conveyor belt through the installation. The major part of the flock which misses or drops past the workpiece is then collected in a collecting tray and is transported back into the bin by a worm and a blower.

Such apparatus, however, requires much space and mechanical expense. Furthermore, constant operation of the flocking circuit is not regulated and not controllable, because the dwell time of the flock in the installation is not measurable. Besides much waste, the flock is also destroyed mechanically due to the elaborate and costly mechanical return, which results in poor quality of the product. Moreover, humidification of the room is indispensable for this heretofore known concept in order to keep the flock conductive.

On the other hand, it is an object of the invention to provide such apparatus, the size of which is only a fraction of conventional apparatus, wherein the flock is not subjected to mechanical stress and thereby suffers no reduction in the conductivity thereof and wherein considerably less waste occurs, even for a higher productivity.

With the foregoing and other objects in view, there is provided, in accordance with the invention, apparatus for electrostatically flock-coating elongated workpieces on a conveyor belt, wherein flock charged by an electrostatic field drops upon a workpiece from a feed opening located above the workpiece to be flock-coated, and excess flock is collected at the bottom of the apparatus and returned to the feed opening including a stationary cylindrical inner housing having a substantially horizontal axis and formed with a feed opening, the feed opening being elongated and located in a region of the cylindrical housing on an upper apex line thereof, the housing being also formed with a discharge gap in a lower region thereof whereat the conveyor belt is simultaneously disposed; a cylindrical outer jacket coaxially surrounding and spaced from the cylindrical inner housing and being rotatable about the inner housing; and elastic transport strips disposed in the space between the inner housing and the outer jacket and fastened to the outer jacket, the elastic transport strips extending along generatrix lines and bridging the space between the inner housing and the outer jacket.

In such very compactly constructed apparatus, the flock is returned without mechanical stress along the shortest path to the forcibly prescribed circuit by the transport means fastened to the outer jacket, which results in considerably lower waste and rejection rates.

In accordance with another feature of the invention, the apparatus includes opposing end walls and opposing planar side walls disposed within the inner housing and downwardly inclined towards one another in the form of a funnel.

The flock is thus fed directly to the conveyor belt and to the workpieces lying thereon.

In accordance with a further feature of the invention, the end walls are formed with passageway openings for the conveyor belt.

In accordance with an added feature of the invention, the apparatus includes brackets engaging the inner housing at end faces thereof for supporting the inner housing on a mobile foundation frame.

In accordance with an additional feature of the invention, the apparatus includes roller means mounted drivably in the foundation frame and supporting the outer jacket.

In accordance with a concomitant feature of the invention, the elastic transport strips are formed as sealing brushes. The flock which falls down near the conveyor belt is returned by the sealing brushes directly back to the feed opening in the upper region of the inner housing.

Other features which are considered as characteristic for the invention are set forth in the appended claims.

Although the invention is illustrated and described herein as embodied in apparatus for electrostatically coating elongated workpieces with flock, it it nevertheless not intended to be limited to the details shown, since various modifications and structural changes may be made therein without departing from the spirit of the invention and within the scope and range of equivalents of the claims.

Figure 2:
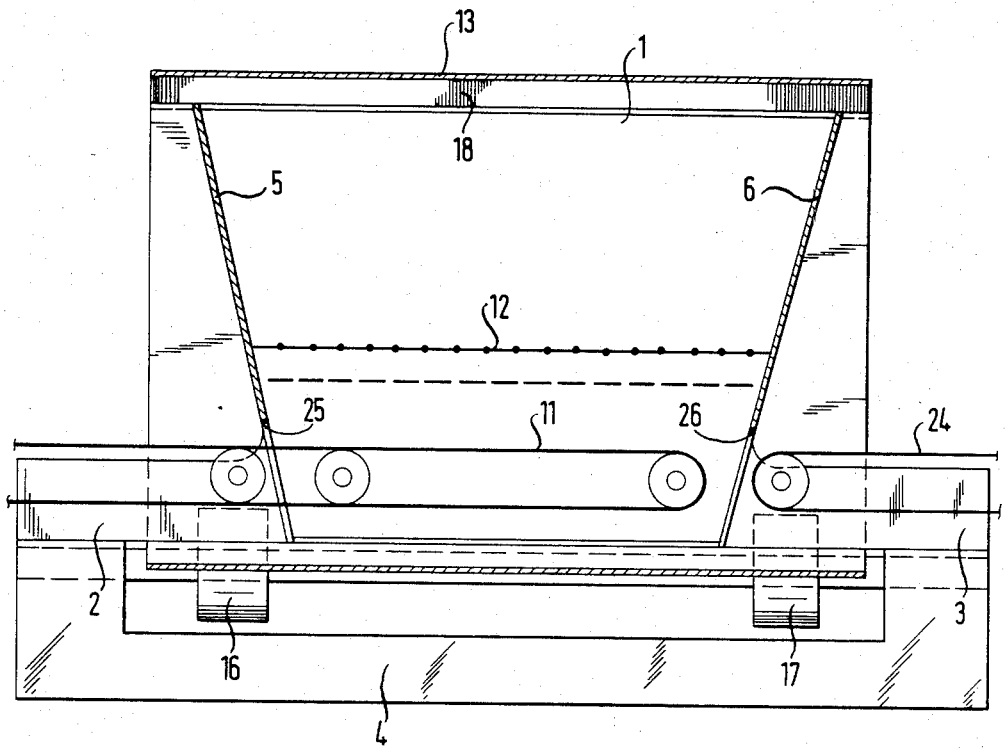

The construction and method of operation of the invention, however, together with additional objects and advantages thereof will be best understood from the following description of specific embodiments when read in connection with the accompanying drawings, in which:

FIG. 1 is a cross-sectional view of apparatus for electrostatically coating elongated workpieces with flock in accordance with the invention; and FIG. 2 is a longitudinal sectional view of FIG. 1 taken along the axis of the apparatus.

Referring now to the figures of the drawing, there is shown therein an apparatus being supported on a foundation frame 4 by brackets 2 and 3 which engage the inner housing 1 at the end faces thereof. In the interior of the cylinder inner housing 1, end walls 5 and 6 as well as planar side walls 7 and 8 are arranged on mutually opposite sides which are downwardly inclined inwardly towards one another to form a funnel-shaped structure. In an upper region of the inner housing 1, a feed opening 9 extending over the entire length of the inner housing 1 is provided, while in a lower region of the inner housing 1, a discharge gap 10 is left free, the latter being so wide that a conveyor belt 11 for feeding-in the workpieces to be flock-coated is able to pass readily therethrough. Above the conveyor belt 11, a metallic grid 12 for electrostatically charging the flock is arranged at about half the height of the horizontally disposed cylindrical inner housing 1.

Coaxial with and spaced from the stationary inner housing 1 is a likewise cylindrical outer jacket 13 which is supported on rolls 14, 15 and 16, 17, respectively, mounted in the foundation frame 4, and rotatably driven thereby. On the inside of this rotating outer jacket 11, strip-shaped brushes 18 which extend over the entire length of the outer jacket 13 are arranged at uniform distances from one another.

The operation of the apparatus is as follows:

The flock delivered by the filling union 21 is transported by the brushes 18 of the rotating outer jacket 13 through the space or gap 22 located between the inner housing 1 and the outer jacket 13 to the upper feed opening 9, and falls freely downwardly therefrom, the flock being charged up in the electrostatic field 12 and impinging upon the workpiece to be flock-coated, such as, a rubber profile or section, for example, and remaining stuck therein. Excess flocks falls down beside the conveyor belt 11 through the discharge gap 10 to the inside of the rotating outer jacket 13 or are hurled downwardly by the conveyor belt 11 at the end of the latter. The workpiece 23 is then seized by another conveyor belt 24, which is arranged only outside the flock chamber per se because of the required potential or power separation. The excess flock is then picked up again by the brushes 18 of the outer jacket 13 and transported upwardly to the feed opening 9.

With the hereinafore-described apparatus according to the invention, a considerably more compact size with considerably smaller dimensions than the flock chambers conventional heretofore, is obtained. Also, no expensive flock bin followed by dosing or metering brushes is required, but only the required amount of flock is kept in circulation and, indeed, on the shortest possible path. The flock can be used up completely without being subjected to mechanical stress or to a reduction in conductivity. Because the apparatus itself is compact and mobile, the color of the flakes can be varied simply by changing the apparatus without requiring additional cleaning and change-over work.

The foregoing is a description corresponding, in substance, to German application No. P 32 32 687.4, dated Sept. 2, 1982, international priority of which is hereby made part of this application. Any material discrepancies between the foregoing specification and the specification of the aforementioned corresponding German application are to be resolved in favor of the latter.

There are claimed:

1. Apparatus for electrostatically flock coating elongated work pieces on a conveyor belt, wherein flock is charged by an electrostatic field drops upon a workpiece from a feed opening located above the workpiece to be flock-coated, and excess flock is collected at the bottom of the apparatus and returned to the feed opening, comprising a stationary cylindrical inner housing having a substantially horizontal longitudinal axis and formed with a feed opening, the feed opening being elongated and located in a region of said cylindrical housing on an upper apex line thereof, the housing being also formed with a discharge gap in a lower region thereof whereat the conveyor belt is simultaneously disposed; a cylindrical outer jacket coaxially surrounding and spaced from said cylindrical inner housing and being rotatable about the inner housing; and elastic transport strips disposed in the space between said inner housing and said outer jacket and fastened to said outer jacket, said elastic transport strips extending along generatrix lines and bridging said space between said inner housing and said outer jacket so as to define therewith respective other gaps for retaining therein given amounts of flock, said other gaps being displaceable about the periphery of said stationary cylindrical inner housing to the feed opening.

2. Apparatus according to claim 1 including opposing end walls and opposing planar side walls disposed within said inner housing and downwardly inclined towards one another in the form of a funnel.

3. Apparatus according to claim 2, wherein said end walls are formed with passageway openings for said conveyor belt.

4. Apparatus according to claim 1 including brackets engaging said inner housing at end faces thereof for supporting said inner housing on a mobile foundation frame.

5. Apparatus according to claim 1, including roller means mounted drivably in the foundation frame and supporting said outer jacket.

6. Apparatus according to claim 1, wherein said elastic transport strips are formed as sealing brushes.

* * * * *